US006600881B2

(12) United States Patent
Cornelius

(10) Patent No.: US 6,600,881 B2
(45) Date of Patent: Jul. 29, 2003

(54) METHODS AND APPARATUS FOR FACILITATING INSTALLATION OF IMAGING MEDIA CARTRIDGES IN IMAGING APPARATUS

(75) Inventor: William Leonard Cornelius, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/045,991

(22) Filed: Oct. 20, 2001

(65) Prior Publication Data

US 2003/0077084 A1 Apr. 24, 2003

(51) Int. Cl.[7] ..... G03G 15/00; G03G 15/08; G03G 21/18

(52) U.S. Cl. ..... 399/12; 399/13; 399/113; 399/262

(58) Field of Search ..... 399/12, 13, 27, 399/28, 111, 113, 119, 120, 227, 262

(56) References Cited

U.S. PATENT DOCUMENTS 5,367,363 A * 11/1994 Kai et al. ..... 399/113
5,530,531 A * 6/1996 Girard ..... 399/120
6,128,453 A * 10/2000 Ban et al. ..... 399/262 X

* cited by examiner

*Primary Examiner*—William J. Royer

(57) ABSTRACT

The invention provides methods and apparatus for facilitating installation of cartridges containing imaging media cartridges into imaging apparatus, such as printers. In one embodiment of the invention a cartridge is configured to contain imaging media. The cartridge is defined by an outer surface and is configured to be received within a designated receptacle defined within an imaging apparatus. The cartridge includes indicia on the outer surface. The indicia is selected to convey to a user a designated orientation of the cartridge with respect to the designated receptacle.

18 Claims, 5 Drawing Sheets

METHODS AND APPARATUS FOR FACILITATING INSTALLATION OF IMAGING MEDIA CARTRIDGES IN IMAGING APPARATUS

FIELD OF THE INVENTION

The invention claimed and disclosed herein pertains to imaging apparatus, and more particularly to methods and apparatus to facilitate the installation of cartridges containing imaging media (such as inks or toners) into the imaging apparatus.

BACKGROUND OF THE INVENTION

The present invention is directed towards imaging apparatus (such as printers and photocopiers), and can be used in monochrome or color imaging apparatus. Most color imaging apparatus use imaging media (such as toner or ink) of four different basic colors to form images on a sheet of print media, such as a sheet of paper. The colors typically used to form the image are cyan, magenta, yellow and black (black technically not being a "color", but will be referred to herein as a "color"). The imaging media is most frequently provided in a self-contained cartridge which can be inserted into, and removed from, the imaging apparatus. The imaging apparatus typically has designated receptacles for receiving individual cartridges so that the cartridges can be individually removed and replaced. Most imaging apparatus require that a cartridge containing a specific color of imaging media be installed in a dedicated receptacle in the imaging apparatus so that the imaging media can be deposited in a predetermined sequence. For example, the imaging apparatus can be configured to apply colors in the sequence of yellow, magenta, cyan and black. Further, if colors are to be applied one on top of another in order to generate a new color (for example, cyan on yellow to develop green), then the imaging apparatus must be able to determine with certainty that the yellow and cyan colors of imaging media are located in the proper locations to be applied at the appropriate times. That is, if the cartridges are randomly inserted into the receptacles, then it is possible that the wrong colors of imaging media can be applied.

In order to ensure that cartridges of imaging media are installed in the correct receptacles, several prior art solutions have been proposed. In one solution, each cartridge is "keyed" so that it will only fit into a preordained receptacle. For example, the cartridge (or the receptacle) can have a uniquely shaped protrusion thereon which is configured to fit within a complementary shaped slot in the receptacle (or cartridge) to ensure that the designated cartridge can only fit within the designated receptacle. This solution is not perfect since it requires the user to locate the keyed portions on the receptacle and the cartridge. Since the keyed portions are not always readily apparent, this can require a substantial amount of handling of the cartridge by the user. Further, if the user accidentally inserts an improperly keyed cartridge into a receptacle, then the cartridge can become jammed in the receptacle. Additionally, keying requires that separate cartridge designs be used for each cartridge of a different imaging media color. This increases manufacturing and inventory costs for the cartridges.

Another solution to ensure that the correct cartridge is installed into the correct receptacle is to mark both the receptacle and the cartridge with a color, such as the color of the imaging media in the cartridge. For example, a cartridge of yellow toner can have a yellow patch applied to the cartridge, and the designated receptacle for the cartridge of yellow toner can likewise have a patch of yellow applied to the receiving area to indicate that the cartridge of yellow toner is to be installed in the marked receptacle. This solution has a couple of problems. First, persons with achromatopsia (color vision deficiency, or "color blindness") may be unable to distinguish the difference between two different color patches. Second, while the solution may be of some help in ensuring that the correct cartridge is installed into a receptacle, it does not provide any guidance for the user regarding the orientation of the cartridge with respect to the receptacle. This can require a user to try several different possible orientations of the cartridge with respect to the receptacle until the correct position is determined. Beyond the fact that this can be an annoyance to the user, it also increases the chance that imaging media can be discharged from the cartridge while handling. Further, cartridges for use in electrophotographic imaging apparatus typically include an optical photoconductor ("OPC") as part of the cartridge. The OPC is commonly hidden behind a moveable shutter to protect it from being contacted by a user (an undesirable event). However, excessive handling of the cartridge increases the chance that the OPC will be exposed and thus subject to damage.

While cartridges are commonly provided with handles to reduce the opportunity for a user to contact the OPC, as well as to help orient the cartridge with respect to the receptacle, the positions of the handles are not always obvious to the user. Further, while the handles may help to orient the cartridge in one direction, they may not be any help for orientating the cartridge in another direction. For example, the presence of a handle at a first end of a cartridge generally indicates that the opposite end of the cartridge is to be inserted into a receptacle along a first axis. However, the handle does not necessarily provide any information as to the rotational orientation of the cartridge about the first axis. This is particularly so when a cartridge is configured to be installed in a receptacle along a length-wise axis.

It should be noted that two of the problems discussed above—orientation of a cartridge with respect to a receptacle and potential accidental exposure of the OPC due to handling of the cartridge—are problems not only for multi-cartridge imaging apparatus, but also for so-called "black-and-white" or one-color imaging apparatus which only use a single cartridge.

Another solution to the problem of ensuring that the correct cartridge is placed in the intended receptacle in a multi-cartridge imaging apparatus is to encode the cartridge and then to provide a sensor in the receptacle area which can detect the encoding on the cartridge. A processor in the imaging apparatus can then determine if the correct cartridge is installed. One drawback to this solution is that typically the cartridge must first be inserted into the receptacle and an access door closed before the processor can determine if the correct cartridge is installed. This requires additional steps on the part of the user and a delay while the processor makes the determination. Further, it does not address the problem of orienting the cartridge with respect to the receptacle, as discussed above.

Yet another solution to facilitate orientation of a cartridge with respect to a cartridge receptacle, and to ensure that the correct cartridge is installed in the intended receptacle, is to print instructions on the cartridge. Beyond the fact that a user may be inclined to ignore detailed instructions, this also requires local language marking of cartridges for different geographic markets. Such localization increases manufacturing and inventory costs, and requires attention to ensure that correctly labeled cartridges are shipped to the correct geographic location.

What is needed then is a method and apparatus to simplify the process of orienting an imaging media cartridge with respect to a receptacle in an imaging apparatus, which achieves the benefits to be derived from similar prior art methods and apparatus, but which avoids the shortcomings and detriments individually associated therewith.

SUMMARY OF THE INVENTION

The present invention provides methods and apparatus for facilitating installation of cartridges containing imaging media into imaging apparatus, such as printers and photocopiers.

A first embodiment of the present invention includes a cartridge configured to contain imaging media, the cartridge being defined by an outer surface and configured to be received within a designated receptacle defined within an imaging apparatus. The cartridge comprises indicia on the outer surface, the indicia being selected to convey to a user a designated orientation of the cartridge with respect to the designated receptacle.

A second embodiment of the present invention includes a plurality of cartridge s configured to contain imaging media . Each cartridge is defined by an outer surface and is configured to be received within a dedicated receptacle defined within an imaging apparatus. Each cartridge comprises unique indicia on the outer surface of the cartridge. When the cartridges are received within the respective designated receptacles, the indicia on the cartridges collectively form an overall pattern.

A third embodiment of the present invention provides for an imaging apparatus having a surface visible to a user. The imaging apparatus defines at least one designated receptacle configured to receive a cartridge containing imaging media. The imaging apparatus has a pattern on the visible surface, and the pattern is selected to correspond to an essentially identical indicia on a cartridge configured to be received within the receptacle.

Another embodiment of the present invention provides for a method of identifying a cartridge configured to contain imaging media and to be received within an imaging apparatus. The method includes providing a cartridge configured to contain imaging media, and placing an indicia on the cartridge. The indicia is selected to convey to a user a designated orientation of the cartridge with respect to the imaging apparatus.

These and other aspects and embodiments of the present invention will now be described in detail with reference to the accompanying drawings, wherein:

DETAILED DESCRIPTION OF THE INVENTION

The present invention provides methods and apparatus for facilitating installation of imaging media cartridges into imaging apparatus. By "imaging apparatus" I mean an apparatus configured to deposit imaging media on sheet media to generate a final imaged product. Examples of imaging apparatus include, but are not limited to, photocopiers and printers. By "imaging media cartridge" (or "cartridge") I mean a cartridge configured to contain imaging media. By "imaging media" I mean the media that is used to create the image on the sheet media. Examples of imaging media include toner and ink. The present invention is directed toward imaging media which is contained within a cartridge so that the process of providing the imaging media to the imaging apparatus is simplified for a user of the imaging apparatus. By "sheet media" I mean any type of media in a sheet form on which an imaging apparatus can form an image using imaging media. Examples of "sheet media" include paper, transparencies and cardstock. While the present invention is particularly useful in color imaging apparatus, it can also be used with monochrome imaging apparatus. By "color imaging apparatus" I mean an imaging apparatus which is configured to apply more than one color of imaging media to sheet media. In this instance, imaging media which is black is to be considered as colored imaging media. By "monochrome imaging apparatus" I mean an imaging apparatus which is configured to apply only one color of imaging media to sheet media. In this instance, the "color" is typically a black imaging media.

Figure 1:
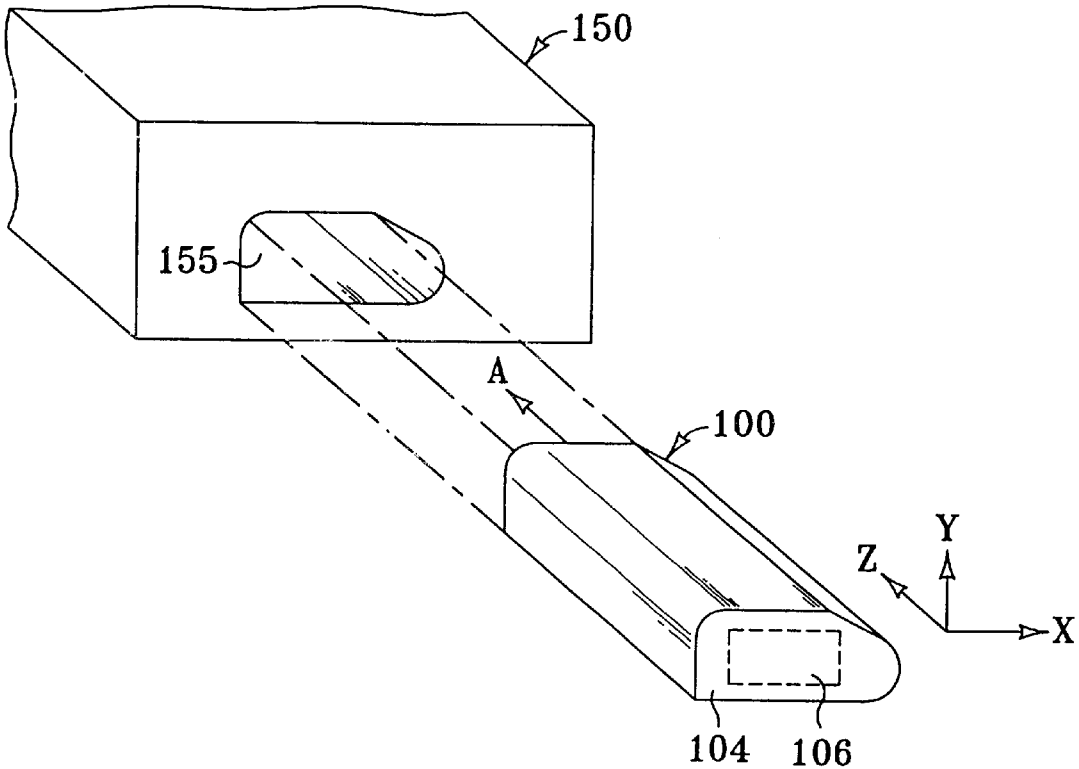
FIG. 1 depicts an oblique view of an imaging media cartridge in accordance with one embodiment of the present invention being inserted into an imaging apparatus.

Turning now to FIG. 1, an imaging media cartridge 100 in accordance with a first embodiment of the present invention is depicted in an oblique view. The cartridge 100 is configured to contain imaging media (not shown), such as toner or ink. In the embodiment depicted, the cartridge is particularly configured to contain toner. The cartridge defined by an outer surface 104, and is further configured to be received within a designated receptacle 155 defined within an imaging apparatus 150 by movement in direction "A" along axis "Z". The cartridge 100 comprises indicia 106 on the outer surface 104 of the cartridge. The indicia 106 is selected to convey to a user a designated orientation of the cartridge 100 with respect to the designated receptacle 155. That is, the indicia 106 is selected to convey to the user the proper orientation of the cartridge 100 in one or more, and preferably all three, of the "X", "Y", and "Z" directions such that the user will be able to correctly orient the cartridge 100 with respect to the receptacle 155 based solely on a visual observation of the indicia 106.

As one example of how the indicia 106 can convey to the user the proper orientation of the cartridge 100 with respect to the receptacle 155, the indicia 106 can be a graphical image which is commonly perceived in a particular orientation such that the orientation of the graphical image corresponds to the correct orientation of the cartridge 100 with respect to the receptacle. An example of such a graphical image can be an image of a person, a landscape, or a physical object. With respect to the example wherein the graphical image is an image of a person, a user will naturally orient the image such that the person depicted by the indicia 106 is in a standing or upright position. Similarly, a graphical image of a landscape (e.g., mountains and trees) will normally cause a user to orient the image, and thus the cartridge on which the image is applied, in a position such that the landscape has a horizon coincident with the normal horizon of vision of the user.

Another example of an indicia 106 which can be applied to the cartridge 100 is that of a text image. For example, the text image can be the name of the manufacturer of the imaging apparatus or of the cartridge. In a similar manner, the indicia can be a company logo which can include graphics as well as the name of the manufacturer or supplier of the cartridge. Since the cartridge will normally be provided to the user in packaging which has the name and logo of the supplier/manufacturer on the container, a user will inherently recognize the logo when it is viewed on the cartridge as the indicia. The user will thus intuitively understand the orientation for the indicia (and thus the orientation of the cartridge) based on a recognition of the logo. Further, the logo can be a trademark of the manufacturer or supplier of the cartridge (or of the imaging apparatus). The use of a trademark as the indicia on the cartridge can increase customer confidence that the cartridge is provided by an authorized supplier.

Figure 2:
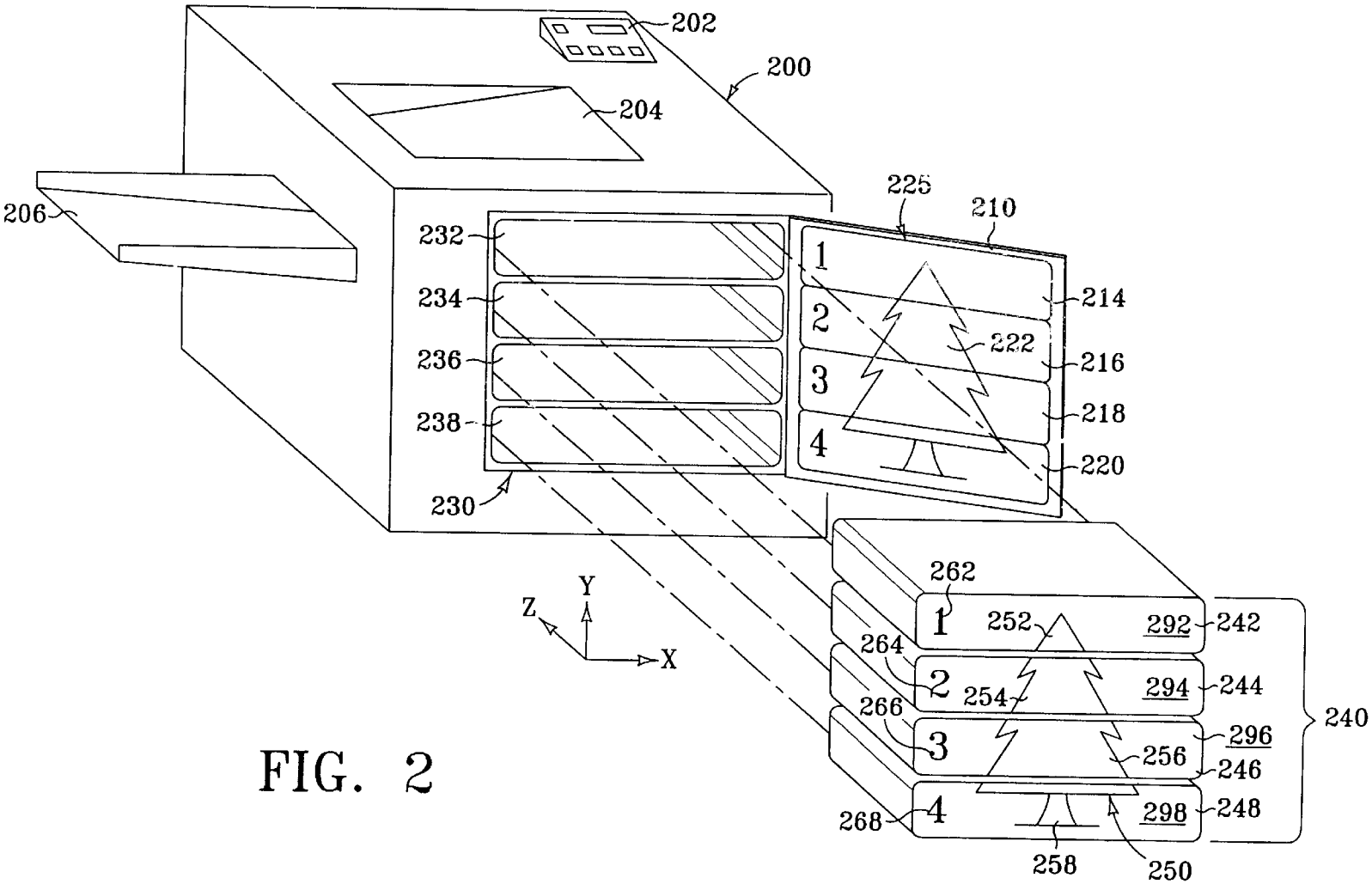
FIG. 2 depicts an oblique view of a four-color imaging apparatus in accordance with the present invention, and four imaging media cartridges being inserted into the imaging apparatus.

As will be seen in the following example, in one embodiment the indicia on the cartridge can comprise one portion of an overall pattern. Turning to FIG. 2, a plurality of cartridges 242, 244, 246 and 248 (collectively, stack 240), each configured to contain imaging media, are stacked in a vertical array. The cartridges can correspond to four cartridges common in a color printer (i.e., cartridges respectively containing imaging media of yellow, magenta, cyan and black). Each cartridge 242, 244, 246 and 248 is configured to be received within an associated dedicated receptacle 232, 234, 236 and 238, defined within an imaging apparatus 200. The receptacles are defined within an opening 230 within the imaging apparatus 200. The opening 230 can be accessed via an access door 210. In the example depicted, the imaging apparatus 200 is also shown as having an infeed tray 204, an outfeed tray 206, and a user console 202. Each cartridge 242, 244, 246 and 248 is defined by a respective outer surface 292, 294, 296 and 298 which supports indicia unique to each cartridge. In the example depicted, the outer surface selected to support the indicia is the front face of each cartridge. That is, the outer surface supporting the indicia is the portion of the cartridge which can be visually observed by a user after the cartridge has been installed into the receptacle in the imaging apparatus 200.

As mentioned, each cartridge 242, 244, 246 and 248 has a unique indicia on the outer surface of the cartridge (i.e., indicia unique to that cartridge). When the cartridges 242, 244, 246 and 248 are received within the respective designated receptacles 232, 234, 236 and 238, the indicia on the cartridges collectively form an overall pattern. Two examples are depicted in FIG. 2. In the first example, the overall pattern is a tree 250, composed of separate indicia 252, 254, 256 and 258 on respective cartridges 242, 244, 246 and 248. Most persons will recognize the overall tree pattern 250, its orientation, and the order in which the indicia 252, 254, 256 and 258 are to be assembled to generate the overall pattern 250. That is, the pattern 250 is virtually universally recognizable as being a tree, with the tree trunk (indicia 258) at the bottom of the stack of cartridges, and with the "point" of the tree (indicia 252) at the top of the stack 240, and with the intermediate portions (indicia 254 and 256) decreasing in size concomitant with ascendancy in the stack 240. In this way, a user will inherently understand the orientation of the cartridge rotationally about the "Z" axis (that is, which direction is "up" for the cartridge), as well as the order of the cartridge in the stack 240.

An example of a second type of pattern is also depicted in FIG. 2. The second pattern comprises a series of numbers 262, 264, 266 and 268 on respective cartridges 242, 244, 246 and 248. The use of near-universal symbols, such as the Arabic numbers depicted, is desirable since each number immediately conveys to a user the orientation of the cartridge about the "Z" axis, independent of where the cartridge is arranged in the stack 240. The series of numbers 262, 264, 266 and 268 also suggests the location of the cartridge in the stack, but there is some room for error here. That is, the selected numbers ("1", "2", "3" and "4") suggest that the cartridges are to be stacked with the numbers in a sequential order, either arranged from top-to-bottom, as indicated in the drawing, or from bottom-to-top (i.e., with the number "4" on cartridge 242, and the number "1" on cartridge 248). When the cartridges are aligned horizontally in the "X" direction (as opposed to the "Y" direction alignment depicted in FIG. 2), then the numbers "1", "2", "3" and "4" can be arranged left-to-right, or right-to-left. Unfortunately, cultural differences do not allow one common standard for determining which number should naturally be on the top of the stack 240 (or on the left side in a horizontal arrangement). Therefore, preferably the numbered indicia 262, 264, 266 and 268 are used in conjunction with a graphic pattern 250. This increases the likelihood that a user will not only intuitively be able to orient a cartridge about the "Z" axis for proper installation in the receptacle, but will also be able to intuitively determine the order of the cartridge in the stack 240.

Thus, the pattern which is generated by the collective indicia on each cartridge (when the cartridges are installed in the receptacles in the imaging device) is preferably selected to convey to a user (1) a particular orientation for the indicia on each cartridge, (i.e., a particular orientation for each cartridge with respect to the respective designated receptacle), and (2) the associated designated receptacle for each cartridge. Similar to the description of the indicia 106 on the cartridge 100 of FIG. 1, the overall pattern which is formed from a plurality of indicia on a plurality of cartridges can be a manufacturer's logo, a company name, and/or a trademark.

Figure 4:
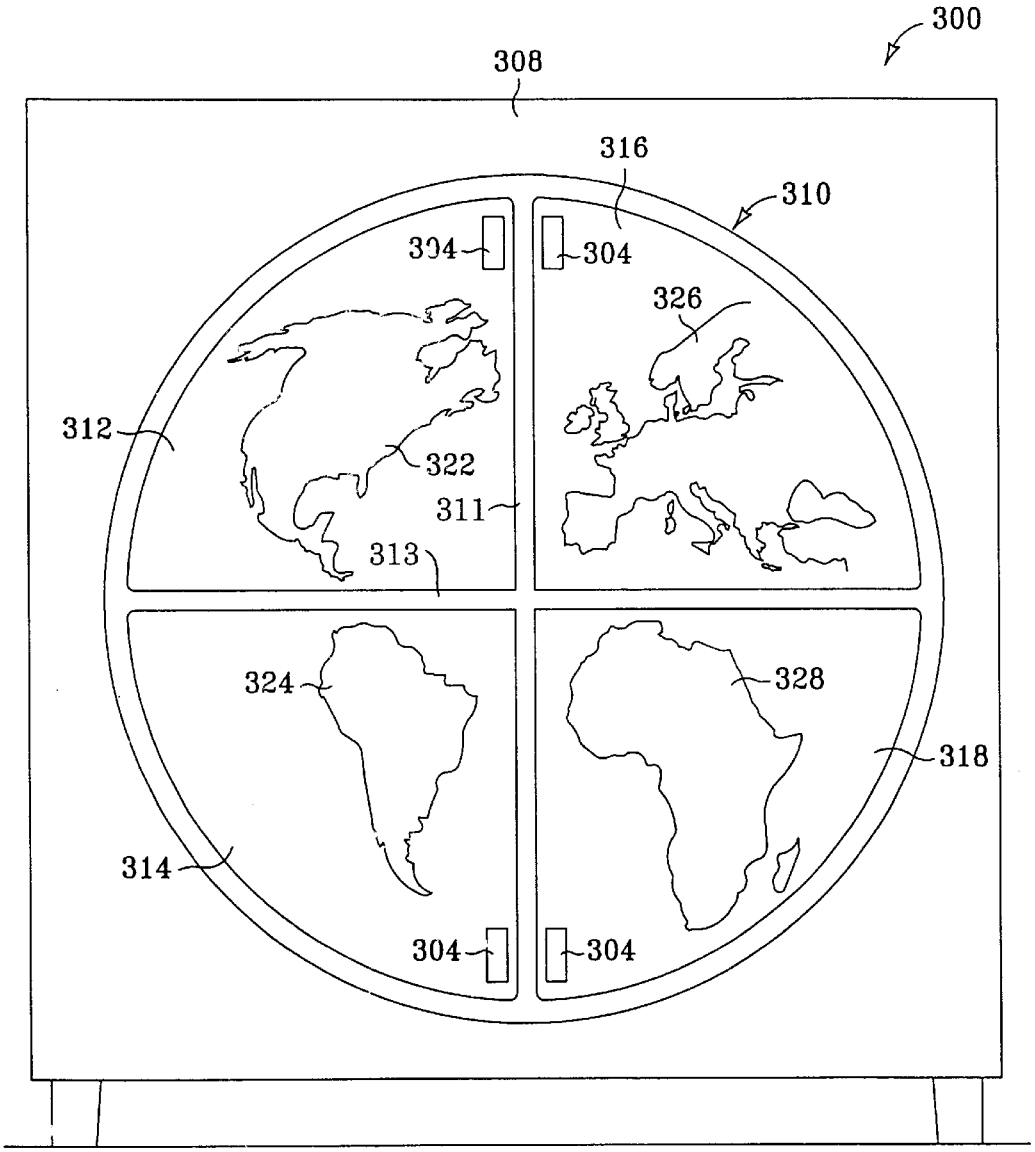
FIG. 4 depicts a side elevation view of four imaging media cartridges in accordance with the present invention, installed into an imaging apparatus.

FIG. 2 depicts a configuration in which the cartridges 242, 244, 246 and 248 (and the indicia supported thereon) are vertically aligned adjacent to one another to be received within the respective designated receptacles 232, 234, 236 and 238. As mentioned previously, the alignment of the cartridges can also be in a horizontal arrangement (such as books on a shelf). Another arrangement of cartridges is depicted in FIG. 4. FIG. 4 depicts a front elevation view of an imaging apparatus 300 which has a body 308 configured to support a carousel 310. The carousel 310 defines receptacles (not numbered) configured to receive four imaging media cartridges 312, 314, 316 and 318. Each cartridge 312, 314, 316 and 318 has respective, unique indicia 322, 324, 326 and 328 supported on a selected surface of the cartridge. In this instance, the selected surface is the front face of the cartridge. The cartridges 312, 314, 316 and 318 are configured to be received within the designated receptacles in the carousel 310 such that the cartridges, and the indicia thereon, are arranged in radially dispersed relationship to one another. (It is understood that, in the example shown, the cartridges 312, 314, 316 and 318 are inserted into the carousel by moving them into the plane of the sheet on which the drawing is shown.) Because of the quarter-circle geometry of the cartridges 312, 314, 316 and 318, the cartridges can only be fit within the receptacles in the carousel 310 in a particular orientation. However, it is possible that the "wrong end" of the cartridge can be inserted in the receptacle. To this end, the existence of the indicia 322, 324, 326 and 328 on a selected surface on each cartridge 312, 314, 316 and 318, as well as the presence of a handle 304 which facilitates installation and removal of the cartridge from the carousel 310, greatly reduces the chance that a user will insert the wrong end of the cartridge into the receptacle.

While the geometry of the cartridges 312, 314, 316 and 318, and the application of indicia 322, 324, 326 and 328 on an outward-facing surface of the cartridges, virtually eliminate the chance that a cartridge will be misoriented with respect to a receptacle, it is still possible for a cartridge to be installed into a receptacle not intended for the particular cartridge. Accordingly, preferably the indicia 322, 324, 326 and 328 are selected to convey to a user the intended receptacle to be associated with a particular cartridge. In the example depicted, the indicia 322, 324, 326 and 328 collectively form a pattern which represents a map of the world. That is, indicia 322 generally depicts a map of North America, indicia 324 generally depicts a map of South America, indicia 326 generally depicts a map of Europe, and indicia 328 generally depicts a map of Africa.

Most users will recognize each of these indicia, and their virtually universally agreed- upon orientation (i.e., with each of the continents depicted by the indicia oriented "up" towards a magnetic north reference, with the northern continents 322 and 326 located in a "northern hemisphere" of the carousel 310, and with the southern continents 324 and 328 located in a "southern hemisphere" of the carousel 310). Additionally, while users may disagree on whether North America should be located to the left or right of Europe on a map, or whether South America should be located to the left or right of Africa on a map, the quarter-shape geometry of the cartridges essentially ensures that a user will correctly associate a cartridge with the intended receptacle in the carousel 310. For example, cartridge 312 will naturally be located in the upper-left receptacle of the carousel 310, since locating it in the upper-right receptacle would require that the indicia 322 be oriented such that the continent of North America were rotated clockwise ninety degrees from the near-universally accepted orientation of North America on a map. Likewise, orienting the cartridge 312 in either of the lower receptacles will result in an uncommon orientation of the indicia 322.

Accordingly, the indicia applied to a plurality of cartridges which are configured to be received within an imaging apparatus preferably convey to a user a unique position of each cartridge with respect to the other cartridges, as well as a unique association of the cartridge with the receptacle in which the cartridge is to be received. This feature is particularly beneficial during initial set-up of an imaging apparatus when no cartridges have been installed in the imaging apparatus. That is, if a user is replacing only one of several cartridges, then the remaining cartridges can act as a map or guide for the placement of the remaining cartridge. However, when no cartridges are installed in the imaging apparatus, then there is no map or guide, and the individual indicia on each cartridge (described above) provides intuitive positioning information to a user.

In another embodiment of the present invention, a map or guide is provided to assist a user in positioning or orienting a cartridge which has indicia applied to it (as described above) with respect to a receptacle in an imaging apparatus. Further, the map or guide can assist a user in making the correct association between the cartridge and the intended receptacle. Accordingly, the present invention provides for an imaging apparatus which has a surface visible to a user. The imaging apparatus defines a plurality of receptacles, each receptacle designated to receive a respective dedicated cartridge containing imaging media. The imaging apparatus has a pattern on the surface of the imaging apparatus. The pattern is selected to correspond to an essentially identical pattern which is produced from indicia on the dedicated cartridges (as described above) when the dedicated cartridges are received within the respective designated receptacles. An example is depicted in FIG. 2. The cartridges 242, 244, 246, and 248 were described above. As previously described, the indicia on each of the cartridges 242, 244, 246 and 248 collectively combine to form a pattern (here, both the graphic pattern of the tree 250, as well as the sequential pattern of the numbers 262, 264, 266 and 268).

In the example depicted in FIG. 2, a pattern 225 is provided on the inside surface of the access door 210. (As described above, the access door 210 allows access to the receptacles 232, 234, 236 and 238 which receive the respective cartridges 242, 244, 246 and 248. When a user opens the access door 210 to install a cartridge into one of the receptacles, then the inside surface of the access door 210 will be visible to the user.) As can be seen, the pattern 225 on the access door 210 is essentially identical to the pattern formed by the stack 240. That is, the pattern 225 includes a graphical image of a tree 222 (corresponding to tree 250), as well as the sequence of numbers down the left side of the pattern 225 (corresponding to the numbers 262, 264, 266 and 268 on the cartridges). Further, the pattern 225 is delineated into four segments 214, 216, 218 and 220 which correspond to the respective cartridges 242, 244, 246 and 248. Accordingly, the pattern 225, which is placed on a surface readily visible to a user when the user is installing cartridges 240 into the receptacles 232, 234, 236 and 238, acts as a visual aid, i.e., a guide or "map", to provide additional assistance to the user in (1) correctly orienting each cartridge with respect to the axes "X, "Y" and "Z", and (2) placing the correct cartridge in the intended receptacle.

Figure 3:
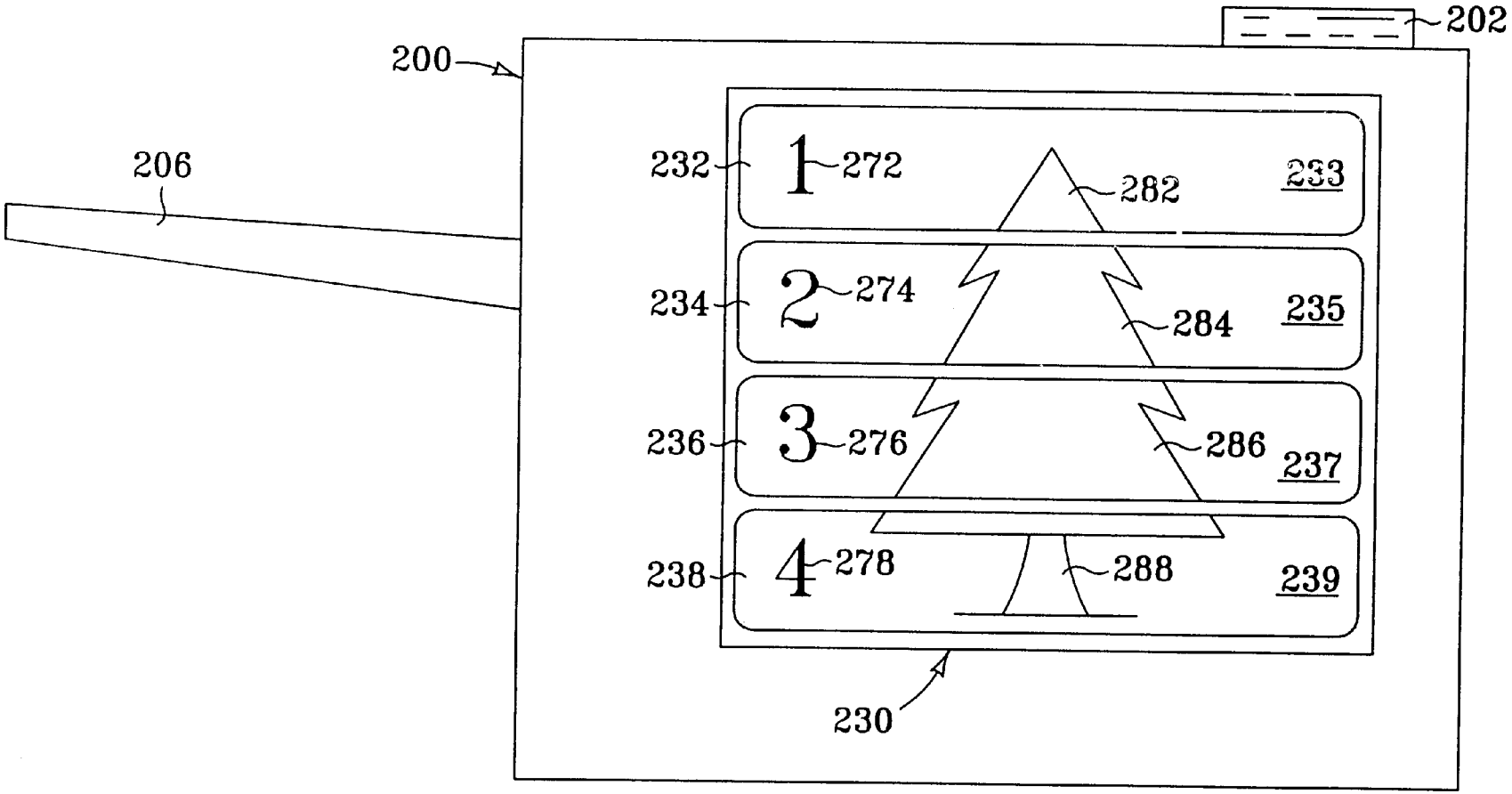
FIG. 3 depicts a front elevation view of the imaging apparatus depicted in FIG. 2.

A variation of the configuration depicted in FIG. 2 is shown in FIG. 3. FIG. 3 depicts a front elevation view of the imaging apparatus 200 of FIG. 2. In this view, the back surfaces 233, 235, 237 and 239 of the respective receptacles 232, 234, 236 and 238 can be seen. Each surface 233, 235, 237 and 239, and thus each receptacle 232, 234, 236 and 238, includes a unique, associated pattern component of an overall pattern which is essentially the same as the pattern 225 (FIG. 2) on the access door 210. Each pattern component is selected to correspond to an essentially identical indicia on a cartridge. In the example depicted, the portions of the pattern in FIG. 3 correspond to the indicia on the cartridges 242, 244, 246 and 248 of FIG. 2. That is: the surface 233 (FIG. 3) includes a graphical image 282 which corresponds to the indicia 252 on the cartridge 242 (FIG. 2), as well as the number "1" (272, FIG. 3) which corresponds to the number "1" (262, FIG. 2) on the cartridge 242; the surface 235 (FIG. 3) includes a graphical image 284 which corresponds to the indicia 254 (FIG. 2) on the cartridge 244, as well as the number "2" (274, FIG. 2) which corresponds to the number "2" (264, FIG. 3) on the cartridge 244; the surface 237 (FIG. 3) includes a graphical image 286 which corresponds to the indicia 256 (FIG. 2) on the cartridge 246, as well as the number "3" (276, FIG. 3) which corresponds to the number "3" (266, FIG. 2) on the cartridge 246; and the surface 239 (FIG. 2) includes a graphical image 288 which corresponds to the indicia 258 (FIG. 2) on the cartridge 248, as well as the number "4" (278, FIG. 3) which corresponds to the number "4" (268, FIG. 2) on the cartridge 248. In this way, a user will be able to match the indicia on any given cartridge with the portions of the pattern depicted on the back surface of the corresponding receptacle (232, 234, 236 or 238). By orienting the cartridge which has indicia matching the portion of the image depicted on the back surface of the receptacle, the user will be able to associate the correct cartridge with the intended receptacle, and will also be able to correctly orient the cartridge for proper insertion into the receptacle.

Accordingly, the pattern (or portion of an overall pattern) which is provided on the surface of the imaging apparatus is selected to convey to a user a designated orientation for each cartridge to be received within the respective designated receptacle. Preferably, the pattern is selected to convey to a user the particular cartridge to be received within a respective dedicated receptacle based on the indicia on the cartridge. Although the use of a pattern placed on an imaging apparatus as a guide for installing the cartridges has been discussed only with respect to the imaging apparatus 200 of FIGS. 2 and 3, the same approach can be used with the imaging apparatus 300 of FIG. 4.

While the example depicted in FIGS. 2 and 3 show the use of a pattern (e.g., 255) applied to a multi-cartridge imaging apparatus in order to facilitate installation of a plurality of cartridges in the imaging apparatus, the same approach can be used for a monochrome imaging apparatus configured to receive only a single cartridge. Thus, in another embodiment of the present invention, an imaging apparatus has a surface visible to a user, such as the inside of an access door, or the back surface (or any other surface) of a receptacle configured to receive a cartridge containing imaging media. The imaging apparatus includes a pattern on this surface, and the pattern is selected to correspond to an essentially identical indicia on a cartridge configured to be received within the receptacle. As with the multi-cartridge imaging apparatus described above, the pattern on the single-cartridge imaging apparatus is selected to convey to a user a designated orientation of a cartridge to be received within the designated receptacle. This can be visually understood by considering the cartridge stack 240 of FIG. 2 as a single cartridge. In this case, the indicia 250 (the graphical image of a tree) on the "cartridge" 240 corresponds to the pattern 222 on the access door 210.

Returning to FIG. 4, as can be seen, the receptacles in the carousel 310 are separated by webs 311 and 313. As can also be seen, the webs 311 and 313 create discontinuities in the overall pattern of the modified world map. Depending on the particular overall pattern, these discontinuities can hinder rapid association of the indicia on a cartridge with the intended receptacle in the imaging device. For example, with respect to the example in FIG. 4 where the pattern is a modified map of the world, the discontinuities have minimal effect on the association between each cartridge and the intended receptacle. This is so for a number of reasons, one of them being that the modified map has inherent discontinuities (for example, Central America does precisely not match between cartridges 312 and 314), and therefore the discontinuities introduced by the webs 311 and 313 are not particularly noticeable. However, where the overall pattern is intended to form a cohesive image, such as a manufacturer's logo, then the affect of the discontinuities can be more significant. Therefore, it is desirable to provide a means within the present invention to remove discontinuities, or the effect thereof, in the overall pattern formed by the collective indicia on the selected surfaces of the cartridges. One example of how this can be done is shown in FIG. 5.

Figure 5:
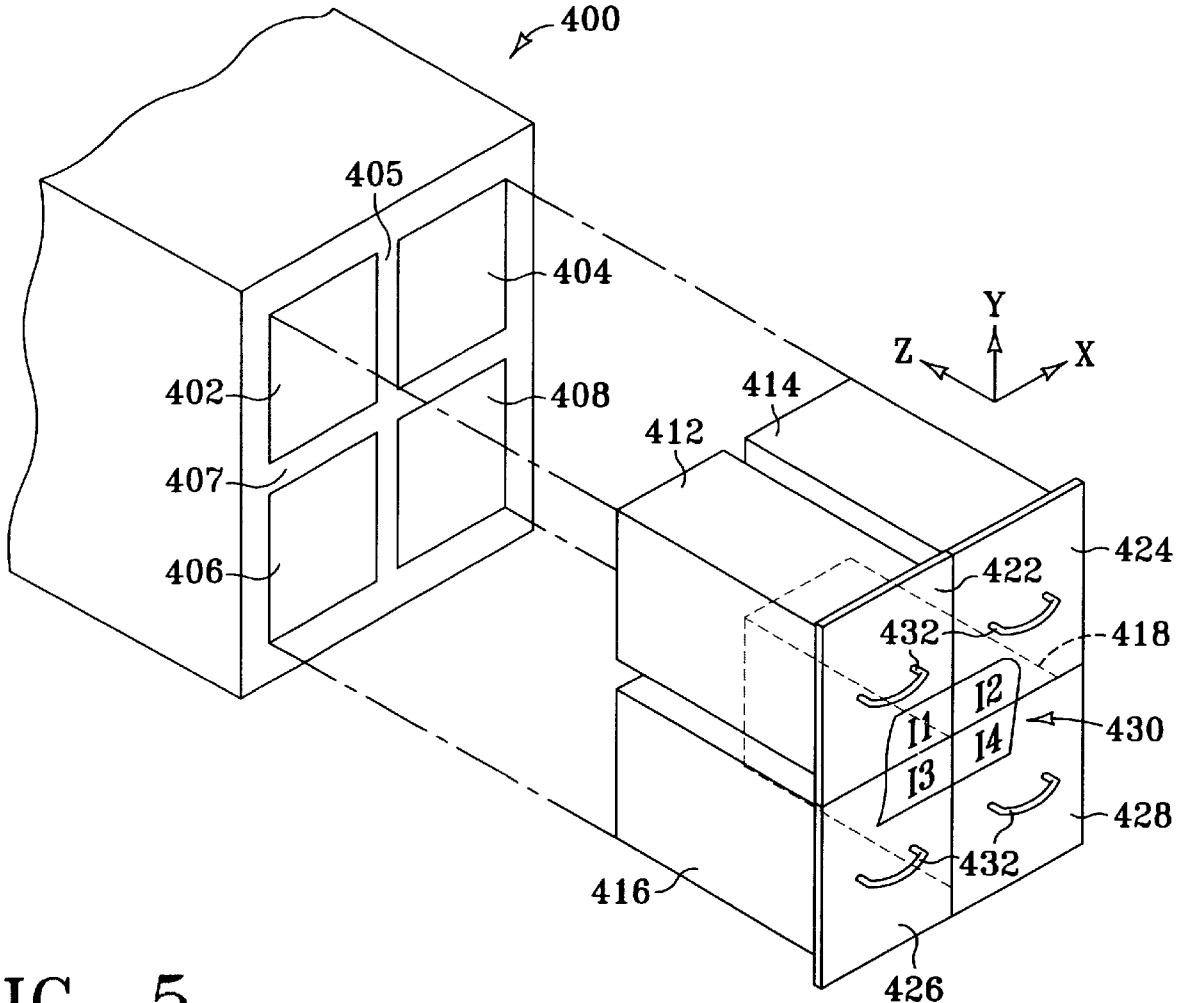
FIG. 5 depicts an isometric diagram of imaging media cartridges in accordance with another embodiment of the present invention being inserted into an imaging apparatus.

FIG. 5 depicts an isometric view of an imaging apparatus 400 (shown in a simplified form) which defines four receptacles 402, 404, 406 and 408 that are separated by intersecting webs 405 and 407 (similar to the webs 311 and 313 of FIG. 4, described above). Imaging media cartridges 412, 414, 416 and 418 are configured to be received within respective receptacles 402, 404, 406 and 408. Each imaging media cartridge is provided with a front cover panel 422, 424, 426 and 428. The front cover panel of each cartridge is larger (in a front-view projection) than the rear-portion of the cartridge, which is the portion intended to be received within the designated receptacle. The cover panels are dimensioned such that, when the cartridges 412, 414, 416 and 418 are installed in the respective receptacles 402, 404, 406 and 408, the front cover panels 422, 424, 426 and 428 form an essentially contiguous surface free of noticeable discontinuities. The essentially contiguous surface formed by the front cover panels 422, 424, 426 and 428 allows the pattern 430 to be formed by the collective indicia 11, 12, 13 and 14. As can be seen, the overall pattern 430 is essentially cohesive such that a user will have an immediate visual perception of the intended pattern.

Since the front cover panels 422, 424, 426 and 428 generally abut one another (with the exception of the diagonal panels 422 and 428), handles 432 can be provided to facilitate removal of the cartridges from the receptacles. An additional benefit of providing the cartridges with front cover panels that are larger than the rear-portion of the cartridge is that this prevents the cartridge from being installed in the wrong direction into the receptacle (since the cover panel will not fit within the receptacle). As described above, each indicia 11, 12, 13 and 14, and the overall pattern 430, is preferably selected to convey to a user the orientation (with respect to axes "X" and "Y") of the cartridge with respect to the receptacles, as well as the position of any particular cartridge with respect to the other cartridges.

Another embodiment of the present invention includes a method of identifying an imaging media cartridge (such as cartridge 100 of FIG. 1) which is further configured to be received within an imaging apparatus (such as imaging apparatus 150 of FIG. 1). The method includes providing an imaging media cartridge (such as cartridge 100, FIG. 1), and placing an indicia (such as indicia 106) on the cartridge. The indicia is selected to convey to a user a designated orientation of the cartridge with respect to the imaging apparatus. Further, when the cartridge is a first cartridge (such as cartridge 242 of FIG. 2, or 312 of FIG. 4), and the indicia is a first indicia (such as respective indicia 252 of FIG. 2, or 322 of FIG. 4), the method can further include providing a second cartridge (such as cartridge 244 of FIG. 2, or 326 of FIG. 4) configured to contain imaging media. Then, the method can include placing a second indicia (such as indicia 254 of FIG. 2, or 326 of FIG. 4) on the respective second cartridge (244, FIG. 2, or 316, FIG. 4). The second indicia is preferably selected to convey to a user a designated orientation of the cartridge with respect to the imaging apparatus. More preferably, the first indicia and the second indicia combine to form an overall pattern (such as pattern 250 of FIG. 2) that is selected to convey to a user a designated orientation of the first cartridge with respect to the second cartridge.

Yet another embodiment of the present invention provides for a method of installing a cartridge containing imaging media (such as ink or toner) into an imaging apparatus (such as imaging apparatus 150, FIG. 1). The method includes providing a cartridge containing imaging media, such as cartridge 100 of FIG. 1. The cartridge has an indicia applied to the cartridge (such as indicia 106, FIG. 1), and, in the manner described above with respect to FIG. 1, the indicia is selected to convey to a user a designated orientation of the cartridge with respect to the imaging apparatus. The method includes visually observing the indicia to determine the orientation of the cartridge with respect to the imaging apparatus, and then orientating the cartridge with respect to the imaging apparatus based on the visual observation of the indicia. Thereafter, the oriented cartridge is installed into the imaging apparatus. When the imaging apparatus is provided with a pattern applied thereto (such as pattern 225 of FIG. 2), and at least a part of the pattern is essentially identical to the indicia (for example, panel 214 of pattern 225 is essentially identical to the indicia 252 and 262 on cartridge 242), then the method can further include using the part of the pattern to further determine the orientation of the cartridge with respect to the imaging apparatus 200.

The method of installing a cartridge containing imaging media into an imaging apparatus can be expanded to provide for installing a second cartridge into the imaging apparatus. That is, let us assume that the first cartridge (described in the previous paragraph) is cartridge 242 of FIG. 2. The method can then include providing a second cartridge (such as cartridge 244 of FIG. 2). As with the first cartridge, the second cartridge also contains imaging media, and has a second indicia applied thereto (such as indicia 254 and 264). As with the indicia on the first cartridge (e.g., indicia 252 and 262 on cartridge 242), the second indicia is selected to convey to a user a designated orientation of the cartridge with respect to the imaging apparatus. Further, the indicia on the second cartridge is essentially identical to a second part of the pattern (such as the portions on the pattern 225 in the second panel 216). The second part of the pattern is then used to further determine the orientation of the first cartridge with respect to the imaging apparatus. For example, the segment of the pattern 225 in the second panel 216 is used as a guide to facilitate orienting the first cartridge 242 with respect to the first receptacle 232. That is, upon viewing the indicia 252 and 262 on the cartridge 242 , and the part of the pattern in the second panel 216, a user will understand that the first cartridge 242 is to be placed above the second cartridge 244.

The method can then further include visually observing the second indicia (as 254, 264) on the second cartridge 244, and visually observing the second part of the pattern (panel 216) to determine the orientation of the second cartridge 244 with respect to the imaging apparatus 200, and also with respect to the first cartridge 242. The second cartridge 244 is then oriented with respect to the imaging apparatus 200, as well as with respect to the first cartridge 242, based on the visual observation of the second indicia (254, 264) and the second part of the pattern (in panel 216). The oriented second cartridge 244 is then installed into the imaging apparatus 200, and more particularly, into the second receptacle 234.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A cartridge configured to contain imaging media, the cartridge defined by an outer surface and configured to be received within a designated receptacle defined within an imaging apparatus, the cartridge comprising indicia on the outer surface, and wherein the indicia is selected to convey to a user a designated orientation of the cartridge with respect to the designated receptacle, and further wherein the indicia comprises one portion of an overall pattern.

2. A plurality of cartridges configured to contain imaging media, each cartridge defined by an outer surface and configured to be received within a designated receptacle defined within an imaging apparatus, each cartridge comprising a unique indicia on the outer surface of the cartridge, and wherein, when the cartridges are received within the respective designated receptacles, the indicia on the cartridges collectively form an overall pattern.

3. The plurality of cartridges of claim 2, and further wherein the overall pattern is selected to convey to a user a particular orientation for the indicia on each cartridge.

4. The plurality of cartridges of claim 2, and further wherein the indicia on each cartridge is selected to convey to a user a particular orientation for each cartridge with respect to the respective designated receptacle.

5. The plurality of cartridges of claim 2, and further wherein the indicia on each cartridge, and the overall pattern, are both selected to convey to a user the associated designated receptacle for each cartridge.

6. The plurality of cartridges of claim 2, and further wherein the overall pattern comprises a manufacturer's logo.

7. The plurality of cartridges of claim 2, and further wherein the cartridges are configured to be received within the designated receptacles such that the indicia are arranged in radially dispersed relationship to one another.

8. The plurality of cartridges of claim 2, and further wherein the cartridges are configured to be received within the designated receptacles such that the indicia are aligned adjacent to one another.

9. An imaging apparatus having a surface visible to a user, the imaging apparatus defining at least one designated receptacle configured to receive a cartridge containing imaging media, the imaging apparatus comprising a pattern on the surface, and wherein the pattern is selected to correspond to an essentially identical indicia on a cartridge configured to be received within the receptacle.

10. The imaging apparatus of claim 9, and wherein the pattern is further selected to convey to a user a designated orientation of a cartridge to be received within the designated receptacle.

11. The imaging apparatus of claim 9, and further wherein the surface is defined within the receptacle.

12. The imaging apparatus of claim 9, and further comprising an access door configured to allow a user access to the designated receptacle, and wherein the surface is defined on the access door.

13. An imaging apparatus having a surface visible to a user, the imaging apparatus defining a plurality of receptacles, each receptacle designated to receive a respective dedicated cartridge containing imaging media, the imaging apparatus comprising a pattern on the surface, and wherein the pattern is selected to correspond to an essentially identical pattern which is produced from indicia on dedicated cartridges when the dedicated cartridges are received within the respective designated receptacles.

14. The imaging apparatus of claim 13, and wherein the pattern on the surface is further selected to convey to a user a designated orientation for each cartridge to be received within the respective designated receptacle.

15. The imaging apparatus of claim 13, and wherein the pattern on the surface is further selected to convey to a user the cartridge to be received within a respective dedicated receptacle based on the indicia on the cartridge.

16. The imaging apparatus of claim 13, and further wherein the pattern on the surface comprises a plurality of unique pattern components, each pattern component being associated with an associated receptacle.

17. The imaging apparatus of claim 16, and further wherein each pattern component is selected to correspond to essentially identical indicia on a cartridge.

18. A method of identifying a cartridge configured to contain imaging media and to be received within an imaging apparatus, comprising:

providing a first cartridge configured to contain imaging media;

placing a first indicia on the first cartridge, and wherein the first indicia is selected to convey to a user a designated orientation of the first cartridge with respect to the imaging apparatus;

providing a second cartridge configured to contain imaging media;

placing a second indicia on the second cartridge, and further wherein the second indicia is selected to convey to a user a designated orientation of the second cartridge with respect to the imaging apparatus; and the first indicia and the second indicia combine to form an overall pattern selected to convey to a user a designated orientation of the first cartridge with respect to the second cartridge.

* * * * *